US007253780B2

(12) United States Patent
Sievenpiper

(10) Patent No.: US 7,253,780 B2
(45) **Date of Patent: *Aug. 7, 2007**

(54) STEERABLE LEAKY WAVE ANTENNA CAPABLE OF BOTH FORWARD AND BACKWARD RADIATION

(75) Inventor: Daniel F. Sievenpiper, Santa Monica, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/402,236

(22) Filed: Apr. 10, 2006

(65) Prior Publication Data

US 2006/0187126 A1 Aug. 24, 2006

Related U.S. Application Data

(62) Division of application No. 10/792,412, filed on Mar. 2, 2004, now Pat. No. 7,071,888.

(60) Provisional application No. 60/470,028, filed on May 12, 2003, provisional application No. 60/479,927, filed on Jun. 18, 2003, provisional application No. 60/470,027, filed on May 12, 2003.

(51) Int. Cl.
*H01Q 9/00* (2006.01)

(52) U.S. Cl. ..... 343/745; 343/756; 343/909

(58) Field of Classification Search ..... 343/909, 343/913, 754, 756, 745, 700 MS
See application file for complete search history.

(56) References Cited

U.S. PATENT DOCUMENTS

| | | | | |
|---|---|---|---|---|
| 4,150,382 | A | 4/1979 | King | 343/754 |
| 6,285,325 | B1 | 9/2001 | Nalbandian et al. | 343/700 MS |
| 6,317,095 | B1 | 11/2001 | Teshirogi et al. | 343/785 |
| 6,404,390 | B2 | 6/2002 | Sheen | 343/700 MS |
| 6,496,155 | B1 | 12/2002 | Sievenpiper et al. | 343/770 |

OTHER PUBLICATIONS

Chen, P.W., et al.,"Planar Double-Layer Leaky Wave Microstrip Antenna," *IEEE Transactions on Antennas and Propagation,* vol. 50, pp. 832-835 (2002).

Wang, C. J., et al., "Two-Dimensional scanning leaky wave antenna by utilizing the phased array," *IEEE Microwave Theory and Techniques,* vol. 12, No. 8 pp. 311-313 (2002).

Sor, J., et al., "A reconfigurable leaky-wave/patch microstrip aperture for phased-array applications", *IEEE Transactions on Microwave Theory and Techniques,* vol. 50, No. 8, pp. 1877-1884 (Apr. 2001).

(Continued)

*Primary Examiner*—Hoang V. Nguyen
(74) *Attorney, Agent, or Firm*—Ladas & Parry

(57) ABSTRACT

Leaky wave antenna beam steering that is capable of steering in a backward direction, as well as further down toward the horizon in the forward direction than was previously possible, and also directly toward zenith. The disclosed antenna and method involve applying a non-uniform impedance function across a tunable impedance surface in order to obtain such leaky wave beam steering.

16 Claims, 10 Drawing Sheets

OTHER PUBLICATIONS

Hu, C., et al., "Analysis and design of large leaky-mode array employing the coupled-mode approach", *IEEE Transactions on Microwave Theory and Techniques,* vol. 49, No. 4, part 1, pp. 629-636 (2001).

Semouchkina, E., et al., "Numerical modeling and experimental study of a novel leaky wave antenna", *Antennas and Propagation Society 2001 IEEE International Symposium,* vol. 4, pp. 234-237 (2001).

Lee, J., et al., "TM-wave radiation from grooves in dielectric-covered ground plane", *IEEE Transactions on Antennas and Propagation,* vol. 49, No. 1, pp. 104-105, 2001.

Yashchyshyn, Y., et al., "The leaky wave antenna with ferroelectric substrate", *14th International Conference on Microwaves, Radar and Wireless Communications,* MIKON- 2002, vol. 1, pp. 218-221, 2002.

Grbic, A., et al., "Experimental verification of backward wave radiation from a negative refractive index metamaterial", *Journal of Applied Physics,* vol. 92, No. 10.

Yang, H.Y.D., et al., "Theory of line source radiation from a metal strip grating dielectric-slab stucture" *IEEE Transactions on Antennas and Propagation,* vol. 48, No. 4, pp. 556-564 (2000).

10°

15 Volts

20°

12 Volts

30°

9 Volts

40°

7 Volts

50°

6 Volts

0°

-10°

-20°

-30°

-40°

-50°

STEERABLE LEAKY WAVE ANTENNA CAPABLE OF BOTH FORWARD AND BACKWARD RADIATION

CROSS REFERENCE TO RELATED APPLICATIONS AND PATENTS

This application is a DIV of Ser. No. 10/792,412 filed on Mar. 2, 2004 now U.S. Pat. No. 7,071,888 which claims the benefits of U.S. Provisional Applications Nos. 60/470,028 and 60/479,927 filed May 12, 2003 and Jun. 18, 2003, respectively, the disclosures of which are hereby incorporated herein by reference.

This application is related to the disclosures of U.S. Provisional Patent Application Ser. No. 60/470,027 filed May 12, 2003 entitled "Meta-Element Antenna and Array" and its related non-provisional application Ser. No. 10/791,185 now abandoned, filed on the day as this application and assigned to the owner of this application, both of which are hereby incorporated by reference.

This application is related to the disclosures of U.S. Pat. Nos. 6,496,155; 6,538,621 and 6,552,696 all to Sievenpiper et al., all of which are hereby incorporated by reference.

TECHNICAL FIELD

This disclosure describes a low-cost, electronically steerable leaky wave antenna. It involves several parts: (1) An electronically tunable impedance surface, (2) a low-profile antenna mounted adjacent to that surface, and (3) a means of tuning the surface to steer the radiated beam in the forward and backward direction, and to improve the gain relative to alternative leaky wave techniques.

BACKGROUND INFORMATION

The prior art includes:

1. Daniel Sievenpiper, U.S. Pat. No. 6,496,155
2. P. W. Chen, C. S. Lee, V. Nalbandian, "Planar Double-Layer Leaky Wave Microstrip Antenna", IEEE Transactions on Antennas and Propagation, vol. 50, pp. 832-835, 2002
3. C.-J. Wang, H. L. Guan, C. F. Jou, "Two-dimensional scanning leaky-wave antenna by utilizing the phased array", IEEE Microwave and Wireless Components Letters, vol. 12, no. 8, pp. 311-313, 2002
4. J. Sor, C.-C. Chang, Y. Qian, T. Itoh, "A reconfigurable leaky-wave/patch microstrip aperture for phased-array applications", IEEE Transactions on Microwave Theory and Techniques, vol. 50, no. 8, pp. 1877-1884, 2002
5. C.-N. Hu, C.-K.C. Tzuang, "Analysis and design of large leaky-mode array employing the coupled-mode approach", IEEE Transactions on Microwave Theory and Techniques, vol. 49 no. 4, part 1, pp. 629-636, 2001
6. E. Semouchkina, W. Cao, R. Mittra, G. Semouchkin, N. Popenko, I. Ivanchenko, "Numerical modeling and experimental study of a novel leaky wave antenna", Antennas and Propagation Society 2001 IEEE International Symposium, vol. 4, pp. 234-237, 2001
7. J. W. Lee, J. J. Eom, K. H. Park, W. J. Chun, "TM-wave radiation from grooves in a dielectric-covered ground plane", IEEE Transactions on Antennas and Propagation, vol. 49, no. 1, pp. 104-105, 2001
8. Y. Yashchyshyn, J. Modelski, "The leaky-wave antenna with ferroelectric substrate", 14th International Conference on Microwaves, Radar and Wireless Communications, MIKON-2002, vol. 1, pp. 218-221, 2002
9. H.-Y. D. Yang, D. R. Jackson, "Theory of line-source radiation from a metal-strip grating dielectric-slab structure", IEEE Transactions on Antennas and Propagation, vol. 48, no. 4, pp. 556-564, 2000
10. A. Grbic, G. V. Eleftheriades, "Experimental verification of backward wave radiation from a negative refractive index metamaterial", Journal of Applied Physics, vol. 92, no. 10
11. J. W. Sheen, "Wideband microstrip leaky wave antenna and its feeding system", U.S. Pat. No. 6,404,390B2
12. T. Teshirogi, A. Yamamoto, "Planar antenna and method for manufacturing same", U.S. Pat. No. 6,317,095B1
13. V. Nalbandian, C. S. Lee, "Compact Wideband Microstrip Antenna with Leaky Wave Excitation", U.S. Pat. No. 6,285,325
14. R. J. King, "Non-uniform variable guided wave antennas with electronically controllable scanning", U.S. Pat. No. 4,150,382

The presently disclosed technology relates to an electronically steerable leaky wave antenna that is capable of steering in both the forward and backward direction. It is based on a tunable impedance surface, which has been described in previous patent applications, including the application that matured into U.S. Pat. No. 6,496,155 listed above. It is also based on a steerable leaky wave antenna, which has been described in previous patent applications, including the application that matured into U.S. Pat. No. 6,496,155 listed above. However, in the previous disclosures, it was not disclosed how to produce backward leaky wave radiation, and therefore the steering range of the antenna was limited. Furthermore, the presently described technology also provides new ways of improving the gain of leaky wave antennas.

A tunable impedance surface is shown in FIGS. 1(*a*) and 1(*b*) at numeral 10. It includes a lattice of small metal patches 12 printed on one side of a dielectric substrate 11, and a ground plane 16 printed on the other side of the dielectric substrate 11. Some (typically one-half) of the patches 12 are connected to the ground plane 16 through metal plated vias 14, while the remaining patches are connected by vias 18 to bias lines 18' that are located on the other side of the ground plane 16, which vias 18 penetrate the ground plane 16 through apertures 22 therein. The patches 12 are each connected to their neighbors by varactor diodes 20.

In FIG. 1(*a*) the biased patches are easily identifiable since they are each associated with a metal plated vias 14 that penetrate the integral ground plane 16 through openings 22 in the ground plane, the openings 22 being indicated by dashed lines in FIG. 1(*a*). The ground patches are those that have no associated opening 22. The diodes 20 are arranged so that when a positive voltage is applied to the biased patches, the diodes 20 reverse-biased.

The return path that completes the circuit consists of the grounded patches that are coupled to the ground plane 16 by vias 14. The biased and grounded patches 12 are preferably arranged in a checkerboard pattern. While this technology preferably uses this particular embodiment of a tunable impedance surface as the preferred embodiment, other ways of making a tunable impedance surface can also be used. Specifically, any lattice of coupled and tunable oscillators could be used.

In one mode of operation that has previously been described in my aforementioned U.S. patent, this surface is used as an electronically steerable reflector, but that is not the subject of the present disclosure. In another mode of operation, the surface is used as a tunable substrate that supports leaky waves, which is the mode that is employed for this technology. This tuning technique has been the subject of other patent applications with both mechanically tuned and electrically tuned structures using a method referred to here as the "traditional method." In a typical configuration using the "traditional method," leaky waves are launched across the tunable surface 10 using a flared notch antenna 30, such as shown in FIG. 2. The flared notch antenna 30 excites a transverse electric (TE) wave 32, which travels across the surface. Under certain conditions, TE waves are leaky, which means that they radiate a portion of their energy 34 as they travel across the tunable surface 10. By tuning the surface 10, the angle at which the leaky waves radiate can be steered. All of the varactor diodes 20 are provided with the same bias voltage, so that the resonance frequency of each unit cell (a unit cell is defined by as a single patch 12 with one-half of each connected varactor diode 20 or equivalently as a single varactor diode 20 with one-half of each connected patch 12) changes by the same amount, and the surface impedance properties are uniform across the surface 10.

The traditional leaky wave beam steering method can be understood by examining the dispersion diagram shown in FIG. 3. The textured, tunable impedance surface 10 supports both TM and TE waves at different frequencies. TM waves are supported below the resonance frequency, denoted by $\omega_1$, and TE waves are supported above it. The "light line," denoted by the diagonal line, represents electromagnetic waves moving in free space. All modes that lie below the light line are bound to the surface, and cannot radiate. See FIG. 4(*a*), which depicts phase matching when radiation is not possible for modes below the "light line." The portion of the TE band that lies above the "light line," on the other hand, corresponds to leaky waves 34 that radiate energy away from the surface 10 at an angle θ determined by phase matching, as shown in FIG. 4(*b*). Modes with wave vectors longer than the free space wavelength cannot radiate, while for shorter wave vectors, the angle of radiation is determined by phase matching at the surface. In the "traditional method," the beam can only be steered in the forward direction where θ is greater than 0° and less than 90°.

The wave vector along the tunable impedance surface must match the tangential component of the radiated wave. The radiated beam can be steered in the elevation plane by tuning the resonance frequency from $\omega_1$ to $\omega_2$. When the surface resonance frequency is $\omega_1$, indicated by the solid line in FIG. 3, a wave launched across the surface at $\omega_A$ will have wave vector $k_1$. When the surface is tuned to $\omega_2$, as indicated by a dashed line in FIG. 3, the wave vector changes to $k_2$, and the radiated beam is steered to a different angle. The beam angle q varies from near the horizon to near zenith as the resonance frequency is increased. In this traditional beam steering method, the entire surface is tuned uniformly. In actual practice, the radiated beam 32 can be steered over a range of roughly 5 degrees to 40 degrees from zenith, as shown in FIGS. 5(*a*)-5(*e*). FIGS. (*a*)-5(*e*) present graphs of measured results using the traditional leaky wave beam steering method with a uniform surface impedance obtained by applying the indicated DC voltages uniformly to all varactor diodes 20 in the electrically tunable surface 10. Radiation directly toward zenith or close to the horizon is not practical, and backward leaky wave radiation is not possible. Measurements were taken at 4.5 GHz for FIGS. 5(*a*)-5(*e*) with patch sizes of 0.9 cm disposed on 1.0 cm centers. The substrate 11 had a dielectric constant of 2.2, and was 62 mils (1.6 mm) thick. The varactor diodes 20 had an effective tuning range of 0.2 to 0.8 pF.

BRIEF DESCRIPTION OF THE TECHNOLOGY

In one aspect presently described technology relates to a new technology for leaky wave beam steering that is capable of steering in a backward direction, as well as further down toward the horizon in the forward direction than was previously possible, and also directly toward zenith. The disclosed antenna and method involve applying a non-uniform voltage function across the tunable impedance surface. If the voltage function is periodic or nearly periodic, this can be understood as a super-lattice of surface impedances that produces a folding the surface wave band structure in upon itself, creating a band having group velocity and phase velocity in opposite directions. An antenna placed near the surface couples into this backward band, launching a leaky wave that propagates in the forward direction, but radiates in the backward direction. From another point of view, the forward-running leaky wave is scattered backward by the periodic surface impedance, resulting in backward radiation.

In another aspect the presently described technology provides an antenna having: a tunable impedance surface: an antenna disposed on said tunable impedance surface, said antenna having a conventional forward direction of propagation when disposed on said tunable impedance surface while said surface has an uniform impedance pattern; and some means for adjusting the impedance of pattern of the tunable impedance surface along the normal direction for propagation so that the impedance pattern assumes a cyclical pattern along the normal pattern of propagation.

BRIEF DESCRIPTION OF THE FIGURES

FIGS. 7(*b*) and 7(*c*) show the alternate voltages being applied to alternate columns of the tunable surface, which effectively doubles the period of the surface and halves the Brillouin Zone size, as can be see in FIG. 7(*a*);

FIGS. 7(*d*) and 7(*e*) show how the voltages on the patches may be determined using a simple reiterative algorithm;

FIGS. 8(*b*) and 8(*c*) show that by using a not-quite-periodic surface impedance, the wave decay can be balanced by the degree of radiation from each region;

FIGS. 12(*b*) and 12(*c*) are graphs of the effective aperture distance versus field strength and demonstrate that by using a non-uniform surface impedance function, the effective aperture length is nearly the entire length of the surface (see FIG. 12(*c*), while a much smaller size is obtained for the uniform impedance function case (see FIG. 12(*b*)).

DETAILED DESCRIPTION OF PREFERRED EMBODIMENTS

Figure 6:
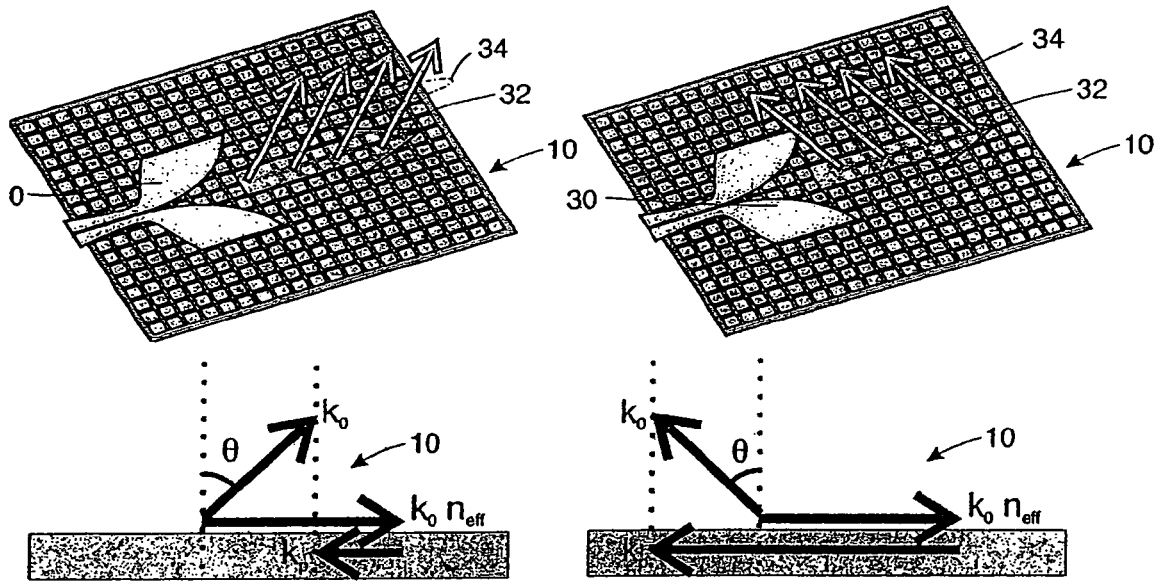
FIG. 6 depicts how the radiation angle for a wave scattered by a non-uniform surface impedance is determined by phase matching at the surface, which angle can result in forward or backward radiation.
Figure 7B:
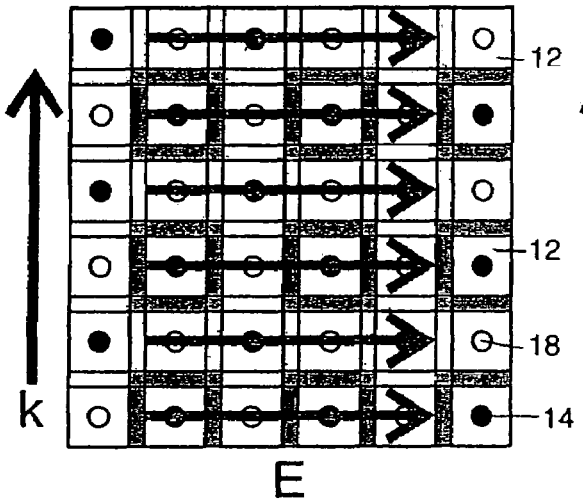
FIG. 7(*a*) shows a dispersion diagram showing the TE band is folded in upon itself, creating a backward band, where the phase and group velocities are opposite, while the TM band does not get folded, because it sees the same period in the direction of propagation, when alternate voltages are applied to alternate columns as shown in FIGS. 7(*b*) and 7(*c*).
Figure 7C:
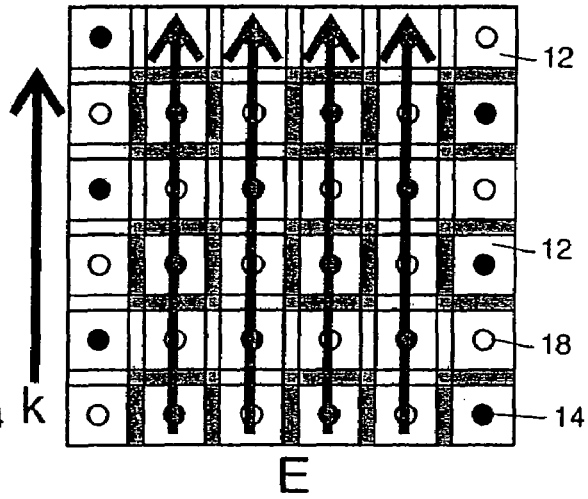
Figure 7A:
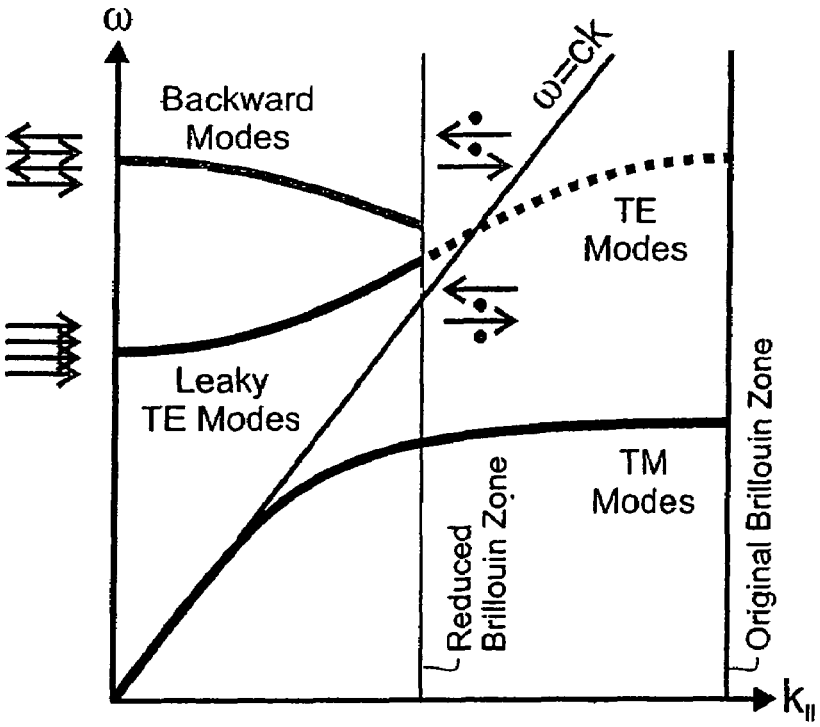
Figure 7D:
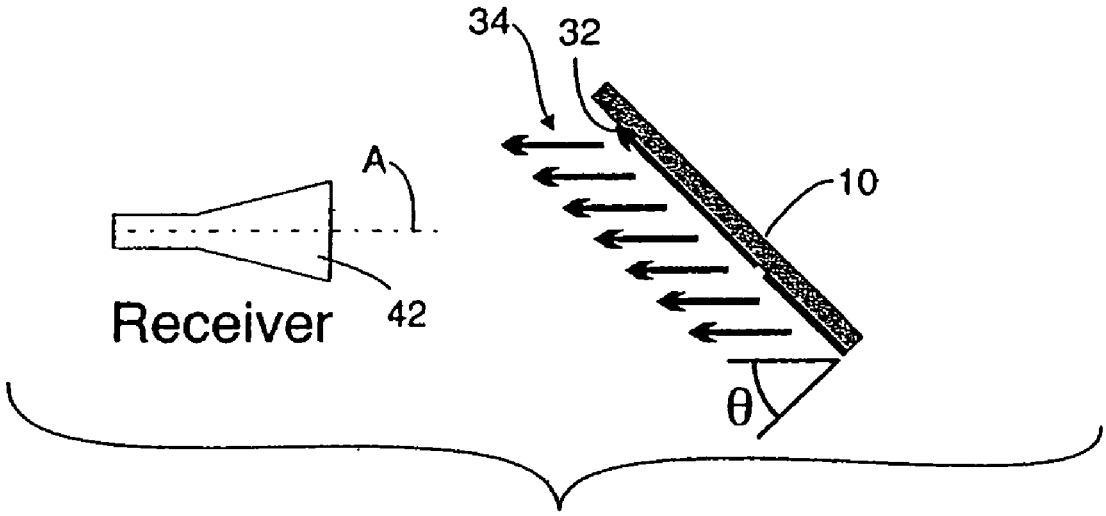
Figure 7E:
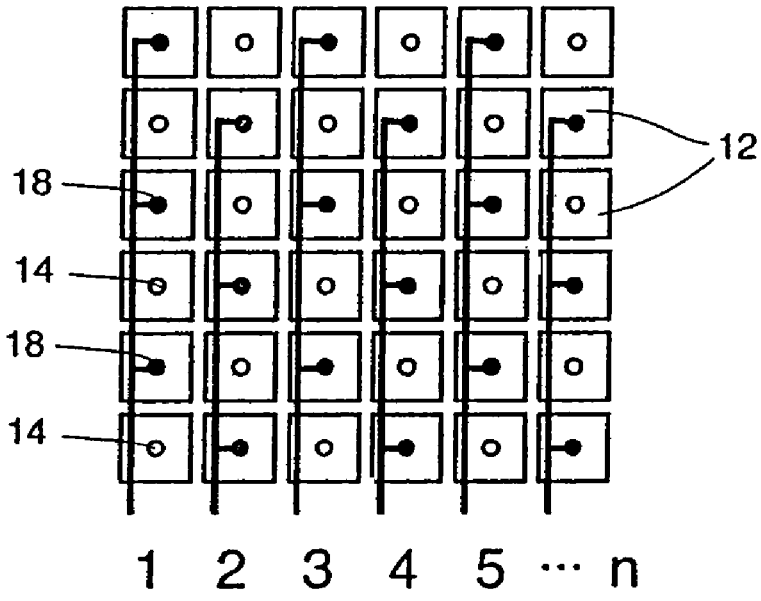

The new beam steering technology disclosed herein can be summarized, in one aspect, by the following statement: The impedance of the tunable impedance surface 10 is tuned in a non-uniform manner to create an impedance function across the surface, so that when a wave 32 is launched across the surface, it is scattered by this impedance function to a desired radiation angle. Typically, impedance function is periodic or nearly periodic. This can be thought of as being equivalent to a microwave grating, where the surface waves are scattered by the grating into a direction that is determined by phase matching on the surface. The radiation angle is determined by the difference between the wave vector along the surface, and the wave vector that describes the periodic impedance function, as shown in FIG. 6.

From another point of view or aspect, the band structure of the tunable impedance surface 10 is folded in upon itself, because the period of the surface has been increased to that of the periodic impedance function, as shown in FIG. 7(*a*). This folding of the band structure results in a backward propagating band, in which the phase velocity and group velocity of the surface waves are in opposite directions. Then, when a leaky wave propagates in the forward direction, it leaks in the backward direction, because the radiation angle is determined by phase matching at the surface. The TM band is not folded because it still sees a uniform surface.

Figure 1A:
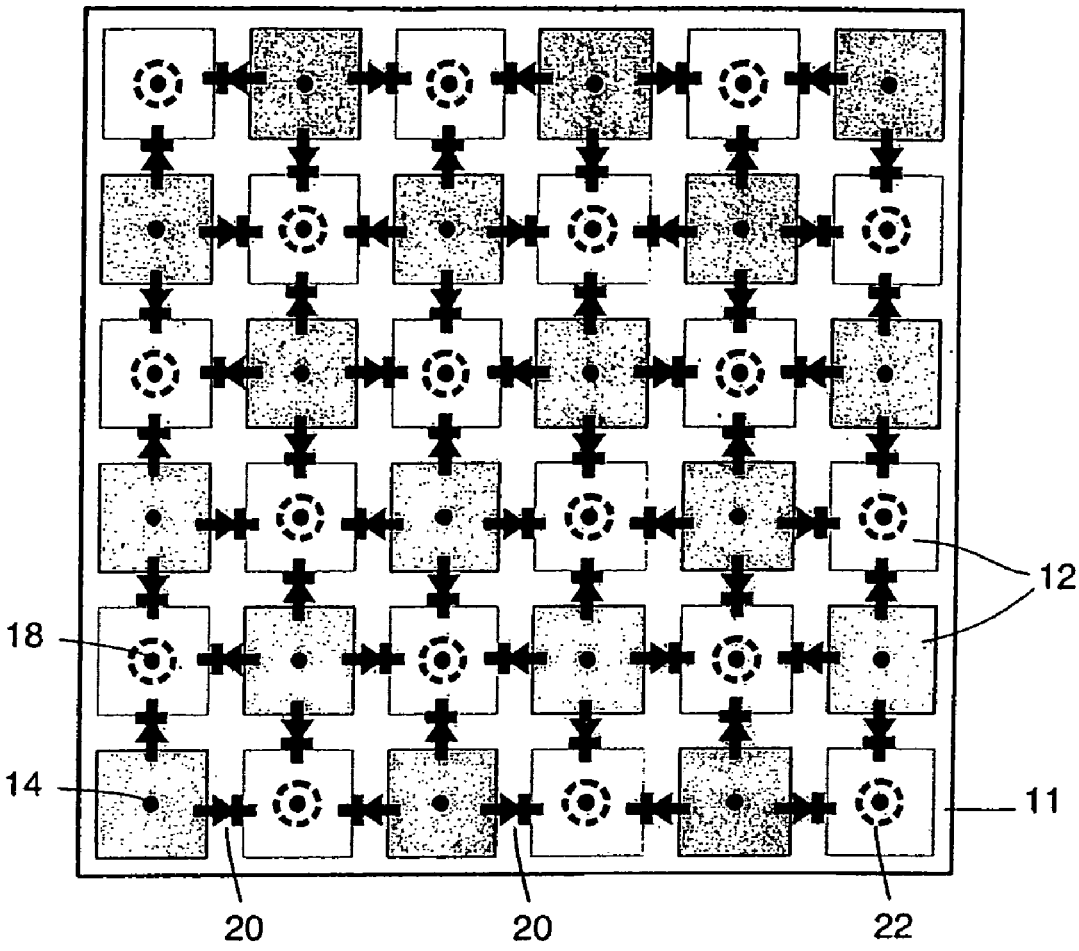
FIGS. 1(*a*) and 1(*b*) are top and side elevation views of an electrically tunable surface.
Figure 1B:
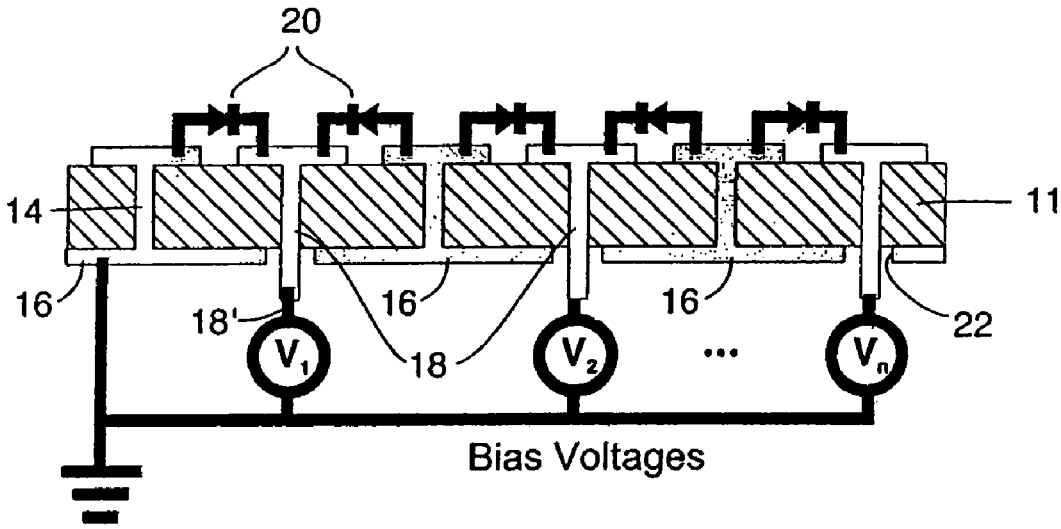
Figure 3:
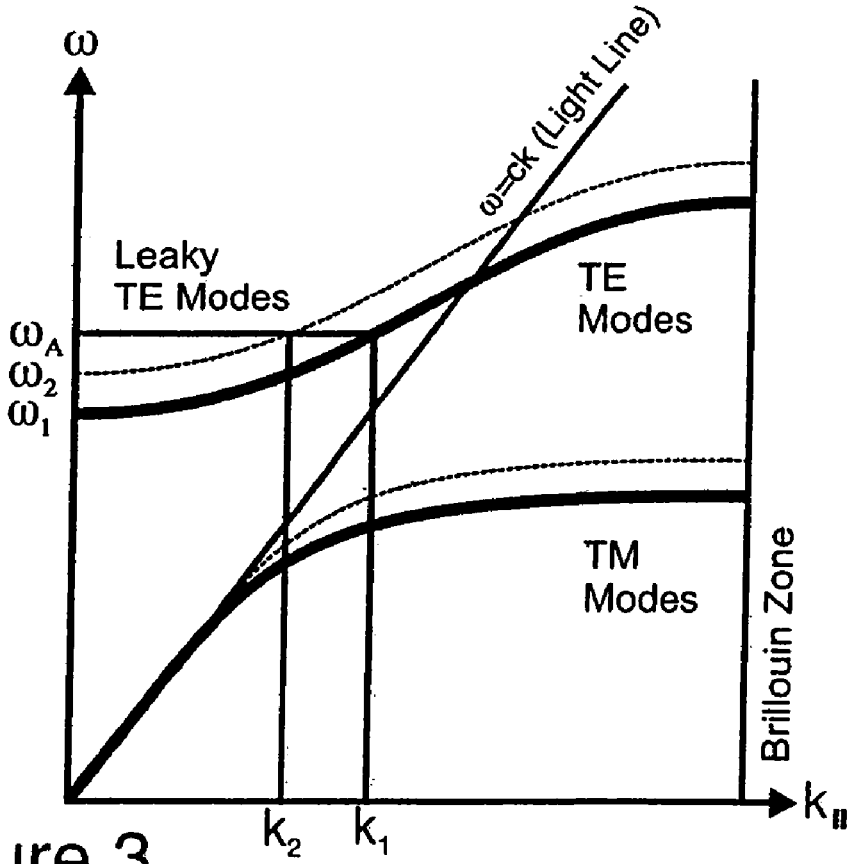
FIG. 3 is a dispersion diagram demonstrating the "traditional method" of leaky wave beam steering.
Figure 4B:
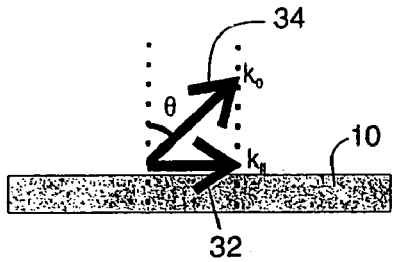
FIGS. 4(*a*) and 4(*b*) depict phase matching when radiation is not possible (FIG. 4(*a*)) and when radiation occurs (see FIG. 4(*b*))
Figure 4A:
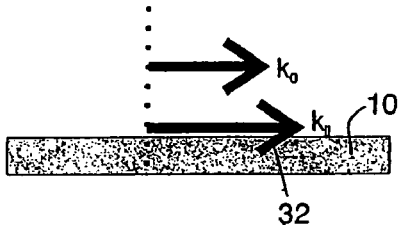
Figure 5A:
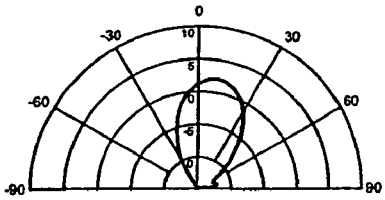
FIGS. 5(*a*)-5(*e*) are graphs of measured results using the traditional leaky wave beam steering method, with a uniform surface impedance.
Figure 5B:
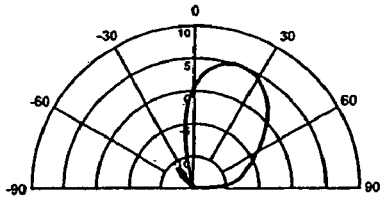
Figure 5C:
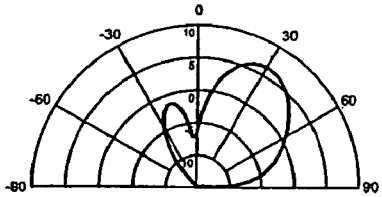
Figure 5D:
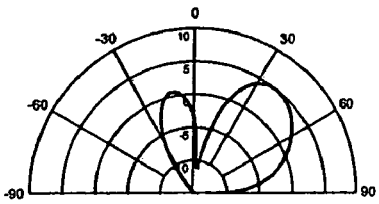
Figure 5E:
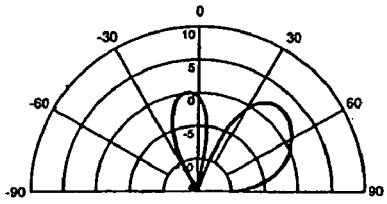

FIGS. 7(*b*) and 7(*c*) diagrammatically depict an experiment that was performed using an electrically tunable surface 10. The solid dots in the center of the patches 12 are grounded vias 14, while the open dots reflect biased vias 18. Alternate columns of patches 12 were biased at two different voltages, which one may call simply high and low. This creates a pattern of bias or control voltages on the variable capacitive elements 20 (preferably implemented as varactor diodes as shown in FIG. 1(*a*)). In FIGS. 7(*b*) and 7(*c*) the relatively high voltages are shown as grey regions between two patches 12, while the relatively low voltages are shown as white regions between two patches 12. Assume a wave is traveling in the direction designated as k, with an electric field polarized in the direction shown by the letter E. Because the orientation of the electric field is different for TE or TM waves (compare FIGS. 7(*b*) and 7(*c*)), respectively, the wave will either see a uniform surface (for the TM case—FIG. 7(*c*)) or a surface with alternating capacitance on each row (for the TE case—FIG. 7(*b*)). This effectively doubles the period of the surface, which can be considered as a reduction of the Brillouin Zone by one-half (compare FIGS. 3 and 7(*a*)). The portion of the TE band that lies in the other half (represented by the dotted line in FIG. 7(*a*)) is folded into the Reduced Brillouin Zone, as shown in FIG. 7(*a*). This new band that is created has phase velocity ($\omega/k$) and group velocity ($d\omega/dk$) with opposite sign: a backward wave.

The variable capacitor elements 20 can take a variety of forms, including microelectromechanical system (MEMS) capacitors, plunger-type actuators, thermally activated bimetallic plates, or any other device for effectively varying the capacitance between a pair of capacitor plates. The variable capacitors 20 can alternatively be solid-state devices, in which a ferroelectric or semiconductor material provides a variable capacitance controlled by an externally applied voltage, such as the varactor diodes mentioned above.

Figure 2:
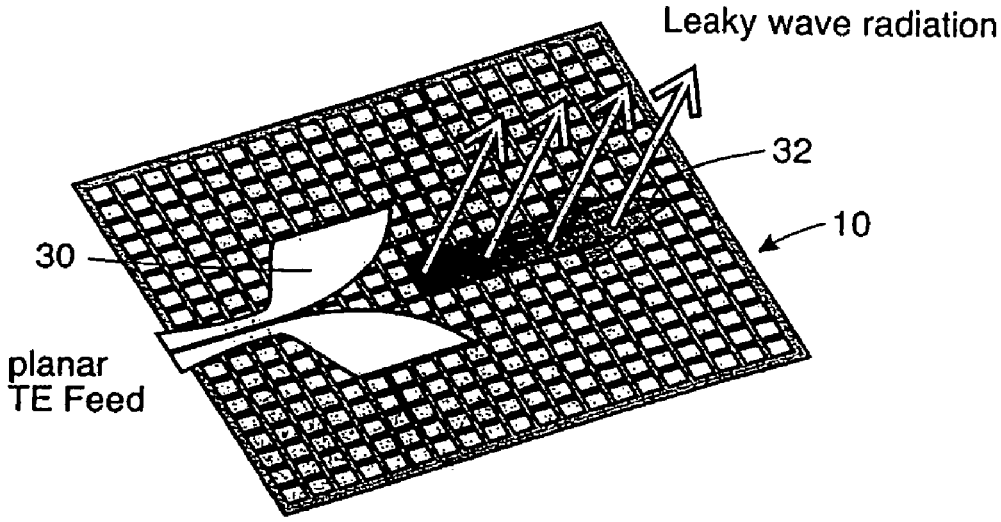
Figure 2 prior art
FIG. 2 depicts a leaky TE wave that is excited on the electrically tunable surface using a horizontally polarized antenna placed near the surface (a flared notch antenna is shown, but other antennas can also be used)

One technique for determining the proper voltages on the patches 12, in order to optimize the performance of the tunable impedance surface at a particular angle $\theta$, will now be described with reference to FIGS. 7(*d*) and 7(*e*). FIG. 7(*d*) shows a testing setup including a receiver horn 42 directed towards a tunable surface 10 which is disposed at the angle $\theta$ with reference to a line perpendicular to surface 10 (which means that the tunable surface 10 is disposed at the angle $90-\theta$ with reference to center axis A of horn 42). The patches 12 on the surface 10 are arranged in columns, such as columns 1-n identified in FIG. 7(*e*). A voltage v is applied to each column and that voltage can be increased or decreased by a voltage $\epsilon$. Thus, the voltages applied to the columns 1-n can be $v-\epsilon$, v or $v+\epsilon$. The tunable surface 10 has an antenna disposed thereon such as the flared notch antenna 30 depicted in FIG. 2. A signal is applied to the antenna and the power of the signal received at horn 42 is measured for each case of $v-\epsilon$, v and $v+\epsilon$. The best of the three cases is selected for column n and the process is repeated for column n+1, cycling through all columns of patches. When the selected voltage values cease to change significantly from one cycle to the next, then the value of $\epsilon$ is reduced and the process is repeated until the fluctuations in the received power are negligible.

This technique takes about fifty cycles through the n columns to converge a good solution of the appropriate values of the bias voltages for the columns of controlled patches for the angle $\theta$. This sort of technique to find best values of the bias voltages is somewhat of a brute force technique and better techniques may be known to those skilled in the art of converging iterative solutions.

Figure 8A:
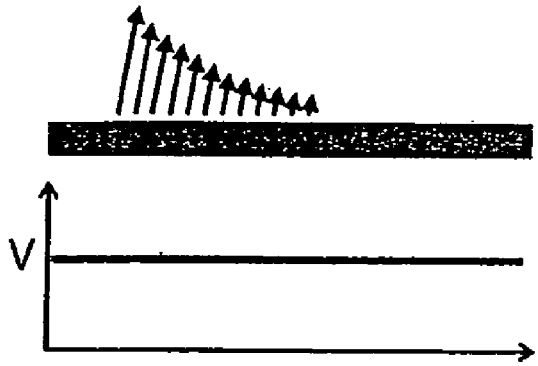
FIG. 8(*a*) shows that with a uniform surface impedance (applied voltage), the tunable surface wave decays as it propagates, limiting the total effective aperture.
Figure 8B:
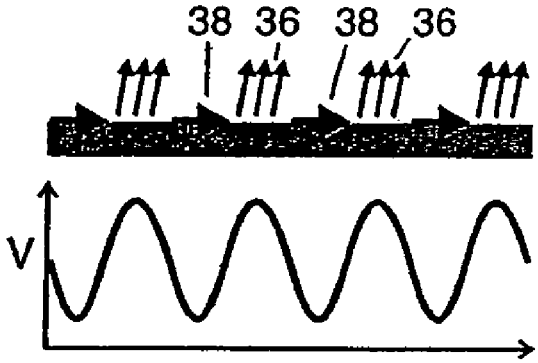
Figure 8C:
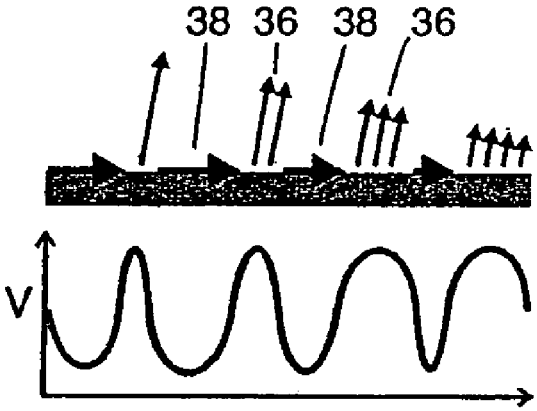
Figure 9A:
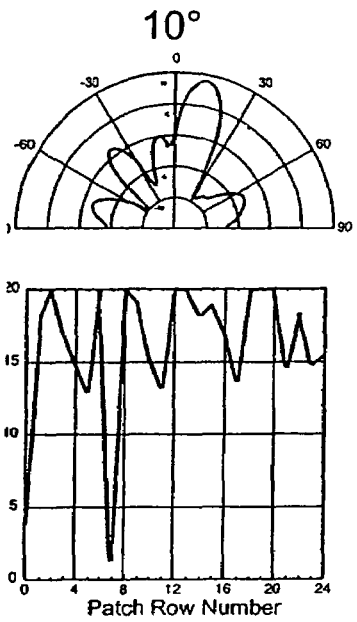
FIGS. 9(*a*)-9(*e*) show, for various angles, beam steering to the forward direction, showing both the radiation pattern and the voltage function used (the voltage pattern was produced using a simple adaptive algorithm, but the periodicity of each case can be seen)
Figure 9B:
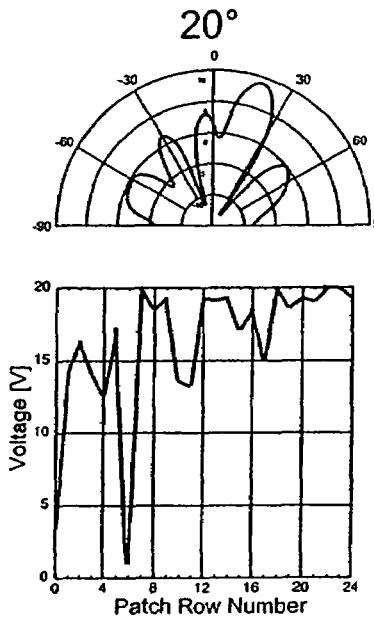
Figure 9C:
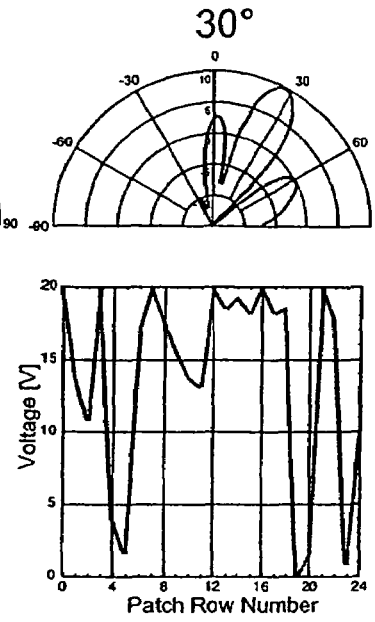
Figure 9D:
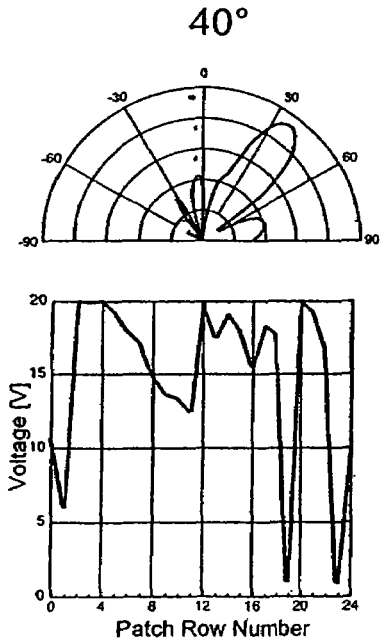
Figure 9E:
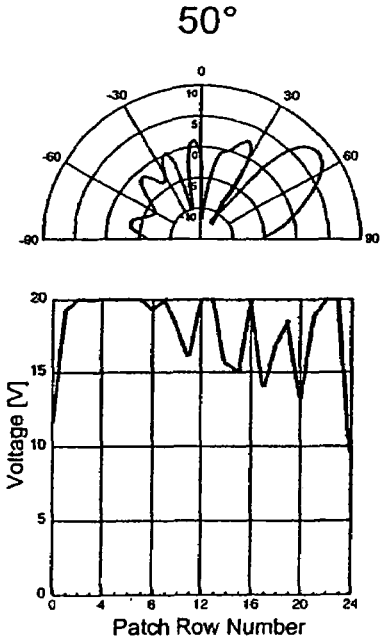
Figure 10A:
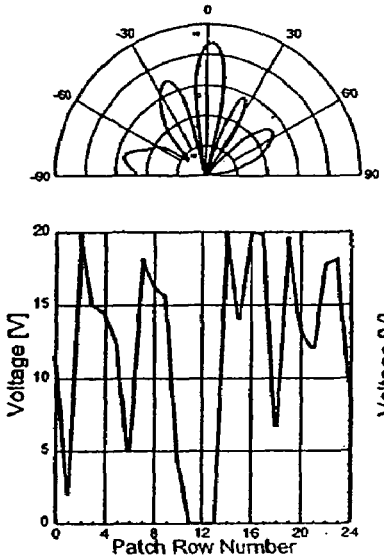
FIGS. 10(*a*)-10(*f*) show, for various angles, beam steering toward the direction normal to the surface, and to the backward direction, showing both the radiation pattern and the voltage function used (the voltage pattern was produced using a simple adaptive algorithm, but the periodicity of each case can be seen)
Figure 10B:
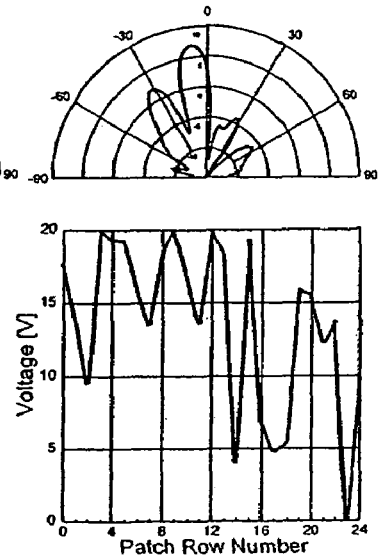
Figure 10C:
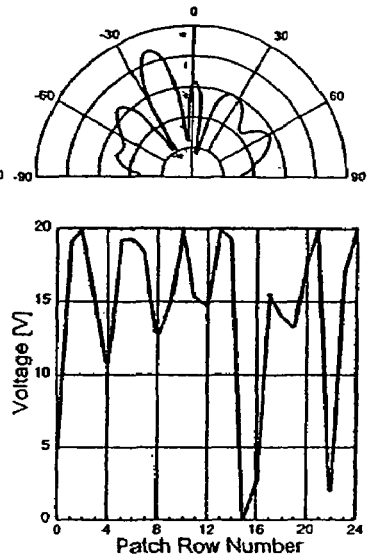
Figure 10D:
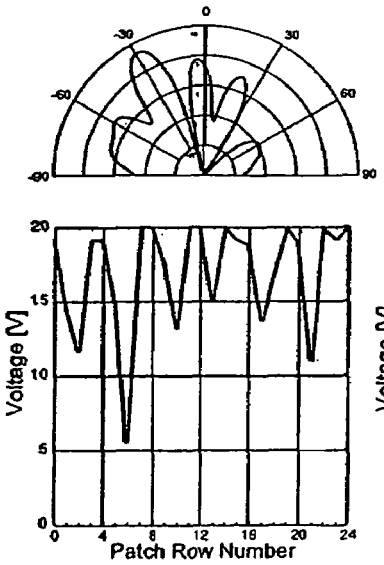
Figure 10E:
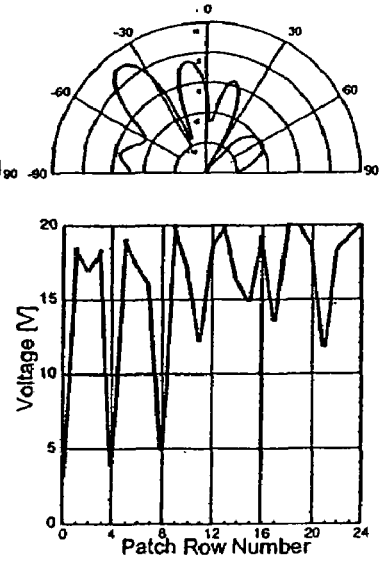
Figure 10F:
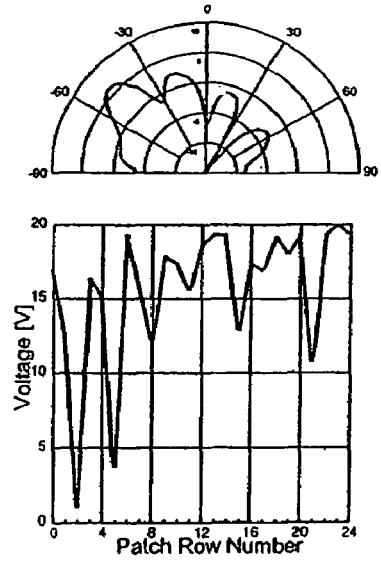
Figure 11:
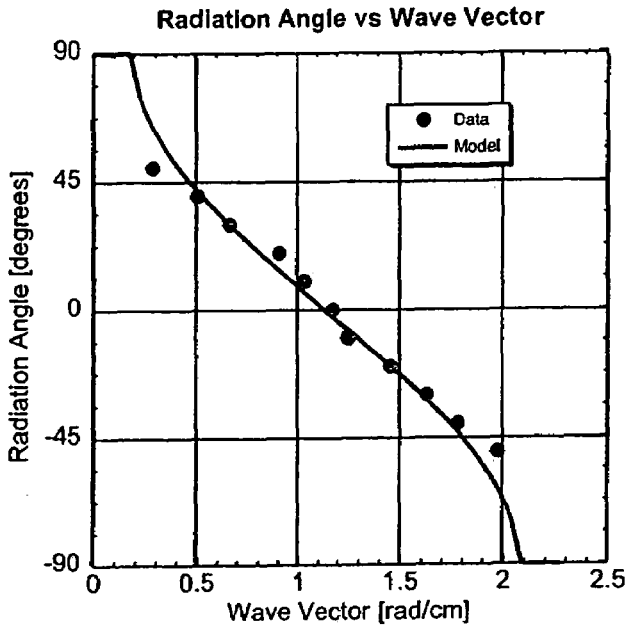
FIG. 11 is a graph of the measured and predicted wave vector of the surface periodicity, and the radiation angle produced by that periodicity.

For a forward propagating wave to leak into the forward direction, uniform impedance could be used, as in the "traditional method." However, better results can be obtained by applying a non-uniform impedance function. One drawback of the traditional uniform impedance method is that the surface is not excited uniformly, because the leaky wave loses energy as it propagates, as shown in FIG. 8(*a*). As a result, the effective length of the radiating surface is much less than the actual length of surface 10 in this figure. However, by applying a non-uniform function to the surface impedance of the tunable impedance surface 10, the effective aperture length can approach the actual length of the surface 10, meaning that the excitation strength is more uniform across the surface 10. This is important for many applications, because it means that a single feed can excite a large area, so fewer feeds can be used, thereby saving expense in a phased array antenna. This can be understood in one way by considering the surface 10 to contain both radiating regions 36 and non-radiating regions 38. In the non-radiating regions 38, the wave simply propagates along the surface. In the radiating regions 36, it contributes to the total radiated field. The surface impedance is tuned in such a way that the phases of the radiating portions add up to produce a beam in the desired direction. See FIG. 8(*b*) where the impedance (and thus the applied voltage V at the columns of patches 12) varies more or less sinusoidally along the length of the surface 10.

The size of the radiating regions can also be controlled so that the decay of the wave is balanced by greater radiation from regions that are further from the source. See FIG. 8(*c*). Of course this model, as well as the band structure folding model or any other model, is an over-simplification of a complex interaction between the wave and the surface, but it is one way to understand the behavior of the tunable impedance surface 10 and to enable antennas using such a surface to be designed.

Using the structure and method described herein, beam steering was demonstrated over a range of −50 to 50 degrees from normal. FIGS. 9(*a*)-9(*e*) show beam steering in the forward direction, for different positive angles, and also the voltages applied to the columns of patches 12 as previously explained with reference to FIGS. 7(*d*) and 7(*e*). FIGS. 10(*a*)-10(*f*) show beam steering to zero and negative angles, for various non-positive angles, and also the voltage applied to the columns of controlled patches 12. In each case of FIGS. 9(*a*)-9(*e*) and FIGS. 10(*a*)-10(*f*), the voltage function is also displayed. The voltages were obtained by applying an adaptive (iterative) algorithm to the surface that maximized the radiated power in the desired direction. The periodicity of voltages can clearly be seen. The shortest period is for the −50 degree case, where the forward propagating surface wave must be scattered into the opposite direction. About six periods can be distinguished in the voltage function for this case. For the zero degree case (see FIG. 10(*a*)), about four periods can be distinguished, while for the +50 degree case (see FIG. 9(*e*)), only about one period is found. In each of these cases, only the most significant Fourier component of the surface voltage function has been considered. Other components also exist, and they probably arise from the need to balance the radiation magnitude and phase across the surface, with a decaying surface wave. Of course, the applied voltages control the impedance function of the electrically tunable surface 10.

Measurements were taken at 4.5 GHz for FIGS. 9(*a*)-10(*f*) with a metal patch 12 size of 0.9 cm square. The patches 12 were disposed on 1.0 cm centers for surface 10. The substrate 11 had a dielectric constant of 2.2, and was 62 mils (1.6 mm) thick. The varactor diodes 20 had an effective tuning range of 0.2 to 0.8 pF. The antenna was a flared notch antenna, as depicted in FIG. 6, with a width of 4.5 inches (11.5 cm) and a length of 5.5 inches (14 cm). Of course any antenna that excites TE waves could be used instead.

As seen in the radiation patterns of FIGS. 5(*a*)-5(*e*), 9(*a*)-9(*e*), and 10(*a*)-10(*f*), the use of a non-uniform surface impedance can provide several advantages. The beam can be steered in both the forward and backward direction, and can be steered over a greater range in the forward direction for the case of the non-uniform applied voltage. As described previously, this can be understood by examining the periodicity of the voltage function that was obtained by the adaptive algorithm that optimized the radiated power in the desired direction. Consider the most significant Fourier component and associate it with the wave vector of an effective grating. A surface wave is launched across the surface, and "feels" an effective index as it propagates along the surface. It is scattered by this effective grating, to produce radiation in a particular direction according to the formula:

$$\theta = \mathrm{Sin}^{-1}\left(\frac{k_0 n_{eff} - k_p}{k_0}\right).$$

The measured data can be fit to this formula in order to obtain the effective index as seen by the surface wave. Based on experimental data, the effective index has been found to be about 1.2. One might expect that the wave sees an average of the index of refraction of the substrate used to construct the surface (1.5), and that of air (1.0), so the observed effective index is reasonable.

Figure 12A:
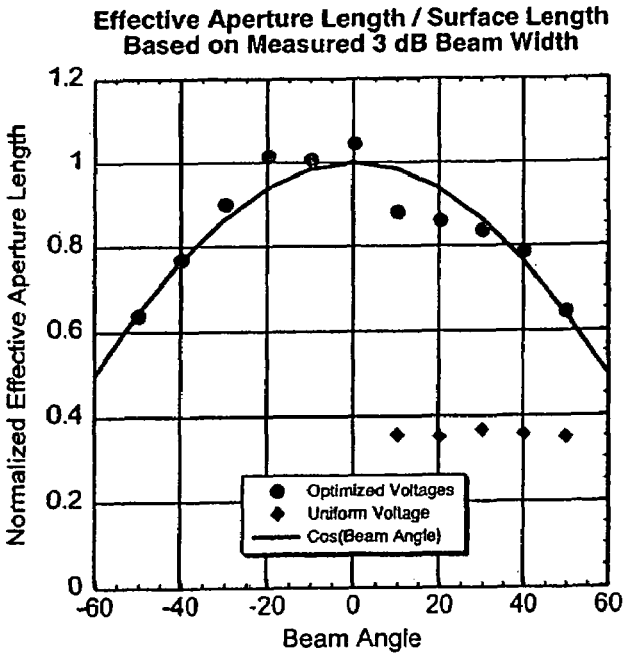
FIG. 12(*a*) is a graph of beam angle versus normalized effective aperture length for cases when the tunable impedance surface has a uniform impedance function (with uniform control voltages applied thereto) and an optimized impedance function (with optimized control voltages applied thereto)
Figure 12B:
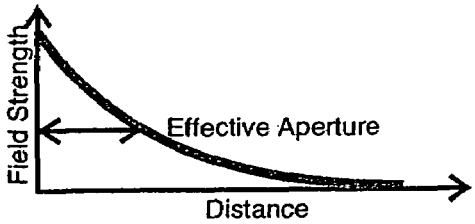
Figure 12C:
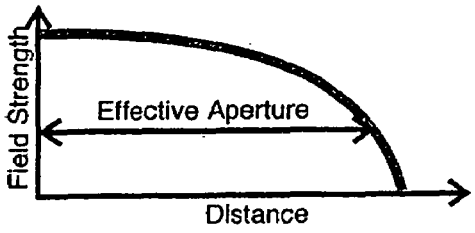

The non-uniform surface also produces higher gain and narrower beam width for the cases of the non-uniform applied voltage. The effective aperture size can be estimated from the 3 dB beam width of the radiation pattern, as shown in FIG. 12(*a*). The case of uniform voltage has nearly constant effective aperture length, as one might expect. As the beam is steered to lower angles, the surface wave interacts more closely with the tunable impedance surface 10, thus extending the effective aperture. In general, the effective aperture of a large antenna should have a cosine dependence, because it appears smaller at sharper angles. By using a non-uniform impedance function on the tunable impedance surface, the effective surface length follows this expected dependence, and it uses nearly the entire length of the surface.

FIGS. 12(*b*) and 12(*c*) are graphs of the effective aperture distance versus field strength and demonstrate that by using a non-uniform surface impedance function, the effective aperture length is nearly the entire length of the surface (see FIG. 12(*c*), while a much smaller size is obtained for the uniform impedance function case (see FIG. 12(*b*)).

The tunable impedance surface 10 that is preferably used is the tunable impedance surface discussed above with reference to FIG. 2. However, those skilled in the art will appreciate the fact that the tunable impedance surface 10 can assume other designs and/or configurations. For example, the patches 12 need not be square. Other shapes could be used instead, including circularly or hexagonal shaped patches 12 (see, for example, my U.S. Pat. No. 6,538,621 issued Mar. 25, 2003). Also, other techniques than the use of varactor diodes 20 can be utilized to adjust the impedance of the surface 10. For example, in my U.S. Pat. No. 6,552,696 issued Apr. 22, 2003 wherein I teach how to adjust the impedance of a tunable impedance surface of the type having patches 12 using liquid crystal materials and indicated above, other types of variable capacitor elements may be used instead.

Moreover, in the embodiments shown by the drawings the tunable impedance surface 10 is depicted as being planar. However, the presently described technology is not limited to planar tunable impedance surfaces. Indeed, those skilled in the art will appreciate the fact that the printed circuit board technology preferably used to provide a substrate 11 for the tunable impedance surface 10 can provide a very flexible substrate 11. Thus the tunable impedance surface 10 can be mounted on most any convenient surface and conform to the shape of that surface. The tuning of the impedance function would then be adjusted to account for the shape of that surface. Thus, surface 10 can be planar, non-planar, convex, concave or have most any other shape by appropriately tuning its surface impedance.

The top plate elements 12 and the ground or back plane element 16 are preferably formed from a metal such as copper or a copper alloy conveniently used in printed circuit board technologies. However, non-metallic, conductive materials may be used instead of metals for the top plate elements 12 and/or the ground or back plane element 16, if desired.

Having described this technology in connection with certain embodiments thereof, modification will now certainly suggest itself to those skilled in the art. As such, the presently described technology needs not to be limited to the disclosed embodiments except as required by the appended claims.

What is claimed is:

1. A method for leaky wave beam steering of an antenna in a backward direction relative to a conventional forward direction of propagation of the antenna, the method comprising:

(a) disposing the antenna on a tunable impedance surface; and (b) applying a non-uniform impedance function across the tunable impedance surface, which impedance function is periodic or nearly periodic, whereby surface waves in said tunable impedance surface are scattered into a direction that is determined by at least in part by said periodic or nearly periodic impedance function.

2. The method of claim 1 wherein applying the non-uniform impedance function across the tunable impedance surface is accomplished by applying a non-uniform voltage function to variable capacitors associated with the tunable impedance surface.

3. The method of claim 2 wherein the non-uniform voltage function is determined by an iterative process of adjusting control voltages of the variable capacitors associated with the tunable impedance surface.

4. The method of claim 3 wherein the tunable impedance surface includes a two dimensional array of conductive patches disposed on a dielectric surface with columns of patches and columns of associated variable capacitors arranged at a right angle to the conventional forward direction of propagation of the antenna.

5. The method of claim 4 wherein the variable capacitors are varactor diodes.

6. A steerable antenna having a desired propagation direction, said steerable antenna comprising:

(a) a tunable impedance surface;

(b) an antenna structure disposed on said tunable impedance surface, said antenna structure having a conventional forward direction of propagation when disposed on said tunable impedance surface when said surface has an uniform impedance pattern; and (c) wherein the impedance pattern of the tunable impedance surface assuming a cyclical pattern to steer the propagation direction of said steerable antenna.

7. The steerable antenna of claim 6 wherein the tunable impedance surface comprises a dielectric substrate having a two dimensional array of conductive patches disposed on a first surface thereof and a ground plane on a second surface thereof, the antenna structure being disposed over the patches on the first surface of the substrate and wherein alternating ones of said patches are coupled to said ground plane and wherein control wires are coupled to other alternating ones of said patches.

8. The steerable antenna of claim 7 wherein capacitive elements are connected between neighboring patches in said two-dimensional array.

9. The steerable antenna of claim 8 wherein the capacitive elements are varactor diodes.

10. The steerable antenna of claim 9 wherein the varactor diodes are controlled by the application of control voltages to said control wires.

11. The steerable antenna of claim 10 wherein the control voltages are associated with columns of said other alternating ones of said patches, the columns being arranged in a direction perpendicular to said conventional forward direction of propagation.

12. A method for beam steering an antenna in a desired direction, the method comprising:

(a) disposing the antenna on a tunable impedance surface;

(b) launching a wave across the tunable impedance surface in response to driving the antenna; and (c) applying a cyclic impedance function across the tunable impedance surface whereby a wave which is launched across the surface in response to driving the antenna is scattered by said impedance function to said desired direction.

13. The method of claim 12 wherein applying the cyclic impedance function across tunable impedance surface is accomplished by applying a non-uniform voltage function to variable capacitors associated with the tunable impedance surface.

14. The method of claim 13 wherein the non-uniform voltage function is determined by an iterative process of adjusting control voltages of the variable capacitors associated with the tunable impedance surface.

15. The method of claim 14 wherein the tunable impedance surface includes a two dimensional array of conductive patches disposed on a dielectric surface with columns of patches and columns of associated variable capacitors arranged at a right angle to a conventional forward direction of propagation of the antenna and wherein the iterative process of adjusting control voltages of the variable capacitors associated with the tunable impedance structure occurs in a column-wise manner.

16. The method of claim 15 wherein the variable capacitors are varactor diodes.

* * * * *